US005451734A

United States Patent [19]

Price

[11] Patent Number: 5,451,734

[45] Date of Patent: Sep. 19, 1995

[54] EXTENSION KIT FOR LIGHT SWITCHES

[76] Inventor: Cecil C. Price, 1917A Hamilton Ct., Langley AFB, Va. 23665

[21] Appl. No.: 263,445

[22] Filed: Jun. 21, 1994

[51] Int. Cl.[6] ..... H01H 15/00

[52] U.S. Cl. ..... 200/331

[58] Field of Search ..... 200/331

[56] References Cited

U.S. PATENT DOCUMENTS

| | | | |
|---|---|---|---|
| D. 274,972 | 8/1984 | Mann, Jr. | 200/331 X |
| 2,668,456 | 2/1954 | Meistrell | 200/331 X |
| 3,839,615 | 10/1974 | Bradford . | |
| 4,295,026 | 10/1981 | Williams et al. | 200/331 |
| 4,421,964 | 12/1983 | Buchtel | 200/331 X |
| 4,771,145 | 9/1988 | Davis, Jr. | 200/331 |
| 5,017,746 | 5/1991 | Guimarin . | |
| 5,055,645 | 10/1991 | Hull et al. . | |
| 5,226,527 | 7/1993 | Maurer et al. | 200/331 |
| 5,374,797 | 12/1994 | McMillan | 200/331 |

FOREIGN PATENT DOCUMENTS

| | | | |
|---|---|---|---|
| 1242236 | 9/1988 | Canada | 200/331 |

*Primary Examiner*—Renee S. Luebke

*Attorney, Agent, or Firm*—Seed and Berry

[57] ABSTRACT

An extension kit for conventional toggle type light or other switches provides for complete enclosure of the switch toggle and the switch actuating rod when installed. A backing plate is provided which secures to the wall at one or more points, to preclude damage to the device or switch by inadvertent leverage being applied to the device. A cover channel secures to the backing plate to completely enclose the actuating rod therein, to prevent wear of the rod against the wall or other adjoining structure. The actuating rod is the only movable component of the assembly, thereby providing simplicity of operation and reliability. The device does not require removal of the conventional switch cover plate for installation, and the backing plate is adapted to be installed over a protruding cover plate while still closely fitting against the wall. The extension switch itself is patterned to closely resemble a conventional switch toggle, and to be similar in operation. The entire device is preferably formed of electrically nonconductive materials, such as plastic, which materials may also be luminescent to assist a person in locating the extension in the dark.

13 Claims, 2 Drawing Sheets

EXTENSION KIT FOR LIGHT SWITCHES

FIELD OF THE INVENTION

The present invention relates generally to devices providing for the remote operation of a toggle switch, and more specifically to a kit installable on a switch and adjacent wall which provides a downward extension of such a switch, for actuation at a lower level than the original switch.

BACKGROUND OF THE INVENTION

Light switches in the home and other locations are generally placed at a height above the floor which is convenient to the average size, physically able adult. The installers of such light switches customarily give little thought to the needs of others, such as children or extremely short adults, those confined to a wheelchair or who may have difficulty in raising their hands for physical or other reasons, etc.

As a result, it has been necessary to provide some means of operating such switches from a point closer to the floor of the structure. Various solutions to the problem have been developed and will be noted in a discussion of the prior art following, but none provide all of the advantages of the present invention.

The need arises for a light switch extension which components may be quickly and easily installable to a light switch and the adjacent wall, and which provides good stability and security for the device. Moving parts must be enclosed for additional stability and security, to preclude inadvertent dislodging of the device by a small child or other person. In addition, luminescence is desirable to assist a person in locating the extension in the dark.

DESCRIPTION OF THE PRIOR ART

U.S. Pat. No. 2,668,456 issued to John V. Meistrell on Feb. 9, 1954 discloses a Switch Operator For Children, comprising a channel which secures to the switch after removal of the switch cover plate. The lower switch extension includes a caricature (i.e., clown face) with the switch lever comprising the tongue of the caricature. The structure is relatively weak, as the only attachment points are at the switch itself; no attachment is provided below the switch to secure the extension to the wall. Moreover, no back enclosure is provided to preclude the operating rod from catching or wearing against the adjacent wall. The switch lever is relatively long and thin, and arcuately pivots about a small pin to lever the extension rod upward and downward by means of another pin attachment. The resulting number of moving parts and leverage provided to a small child by the relatively large switch lever, as well as the lack of support below the switch, render the Meistrell device prone to damage, especially by small children. The caricature could encourage children to use the device as a toy, rather than as the electrical device it comprises.

U.S. Pat. No. 3,839,615 issued to James M. Bradford on Oct. 1, 1974 discloses an Adaptor For Electric-Light Wall Switch For Operation By Small Children. Many of the same points raised above with the Meistrell device are applicable here, including the susceptibility to damage and treatment as a toy. In additions, Bradford provides a light at the caricature when the room light is off, powered by a small battery independent of the electrical system of the structure. The nearly constant drain on the small battery when the light is off would rapidly deplete the system. No non-electrical luminescence is disclosed, as in the present device.

U.S. Pat. No. 4,295,026 issued to Allen C. Williams et al. on Oct. 13, 1981 discloses a Switch Adapter Mechanism providing plural positions for an actuating knob. As with the Meistrell apparatus discussed above, the switch cover plate must be removed for installation of the Williams et al. device. The relatively large and protruding knob, as with the caricatures of the above discussed devices, presents some hazard that it will be inadvertently snagged or otherwise damaged. No guard is provided between the actuating rod and the wall, as in the devices discussed above, nor is any luminescence of the device disclosed.

U.S. Pat. No. 4,771,145 issued to Kenneth E. Davis, Jr. on Sep. 13, 1988 discloses a Light Switch Extension having a lower toggle which causes rotary motion of a cain wheel, which in turn operates a rod in reciprocating motion to operate a light switch. As in the Meistrell and Bradford devices discussed above, the Davis, Jr. device is relatively complex, having multiple moving parts. Again, no guard is provided between the wall and the moving rod, nor is any luminescence disclosed.

U.S. Pat. No. 5,017,746 issued to Henry L. Guimarin on May 21, 1991 discloses a Low Cost Light Switch Extension having a switch actuating rod which hooks over the standard switch toggle, and is retained thereon by an arcuate keeper which loops through a passage in the upper end of the rod below the switch toggle engagement. The lower end of the actuating rod is unsupported, which means that any inadvertent lateral movement thereof would produce sufficient leverage at the switch actuation end to likely damage either the switch activation rod, the keeper, and/or the switch itself. No guard is provided between wall and moving rod, or luminescence, as in the present invention.

U.S. Pat. No. 5,055,645 issued to Harold L. Hull et al. on Oct. 8, 1991 discloses a Light Switch Extension comprising a spherical fitting which secures to the switch toggle and is captured between two cooperating plates. One of the plates has a switch actuating rod extending therefrom. The rod may be rotated about the switch by 180 degrees or more adjacent to the wall, to place the rod out of a child's reach. Accordingly, the distal end of the rod is unsupported and may contact the wall, and further may be pulled outward from the wall, resulting in possible damage to the device and/or the switch to which it is attached. The device is not luminescent, as provided by the present extension.

U.S. Pat. No. D-274,972 issued to Billy F. Mann, Jr. on Aug. 7, 1984 discloses a design for a Child's Light Switch Extension comprising a thin, wire-like rod having a switch engaging loop at one end and a triangular grasping loop at the other. A channel is provided up the wall to enclose the rod. The channel is apparently secured to the wall, as no other means is evident for retaining the rod on the switch toggle. However, no disclosure is made of any structure between the movable rod and the wall. The device bears no resemblance to a conventional switch toggle and no luminescence is disclosed, as in the present invention.

Finally, Canadian Patent No. 1,242,236 to Luc Lafond and published on Sep. 20, 1988 discloses an Electrical Toggle Switch Remote Operator comprising a switch actuating rod and a channel securable thereover. No luminescence or protection between wall and rod is provided. Cover plates are provided over two holes in the channel, which cover plates engage the switch and lower end of the rod. Either cover plate may be locked in position to prevent operation of the switch toggle, as desired.

None of the above noted patents, taken either singly or in combination, are seen to disclose the specific arrangement of concepts disclosed by the present invention.

SUMMARY OF THE INVENTION

By the present invention, an improved extension kit for light switches is disclosed.

Accordingly, one of the objects of the present invention is to provide an improved light switch extension device which may be provided in the form of a kit for ease of installation thereof.

Another of the objects of the present invention is to provide an improved light switch extension kit which includes a single moving component to provide for simplicity and reliability of operation when installed.

Yet another of the objects of the present invention is to provide an improved light switch extension kit which provides an enclosure for the movable switch extension rod which surrounds and encloses the rod to preclude wearing of the rod against any other structure.

Still another of the objects of the present invention is to provide an improved light switch extension kit which provides for the complete enclosure of the switch toggle.

A further object of the present invention is to provide an improved light switch extension kit which includes guide means within the movable rod enclosure to ensure smooth operation of the rod and reduce unwanted motion thereof.

An additional object of the present invention is to provide an improved light switch extension kit which switch extension has the same general form and motion as a conventional light switch toggle.

Another object of the present invention is to provide an improved light switch extension kit which provides security for the intermediate and/or lower ends of the movable rod and enclosure.

Yet another object of the present invention is to provide an improved light switch extension kit in which all components are preferably formed of electrically non-conductive materials, which materials may include luminescent or non-luminescent plastic.

Still another object of the present invention is to provide an improved light switch extension kit which is adapted to be secured to a switch over an existing switch cover plate, and which does not require the removal thereof.

A final object of the present invention is to provide an improved light switch extension kit for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
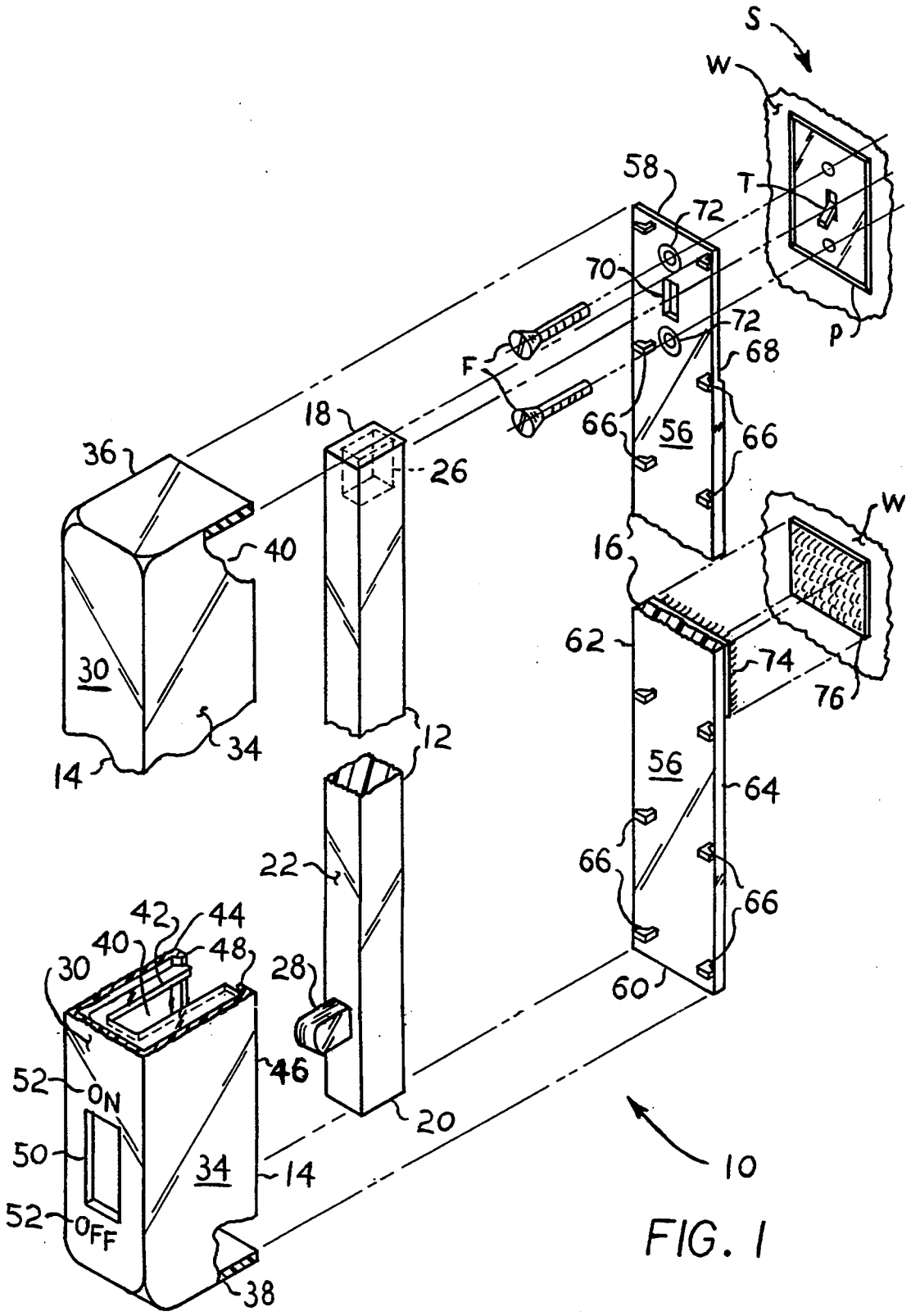
FIG. 1 is an exploded perspective view of the present extension kit for light switches, showing the various components thereof and their relationship to one another and to a conventional toggle type light switch.

Referring now particularly to FIG. 1 of the drawings, the present invention will be seen to relate to a kit or assembly providing for the remote actuation of a conventional wall mounted toggle type light or other switch S when installed thereto. The switch extension kit 10 comprises a movable extension rod 12, a fixed enclosure channel 14 providing for the enclosure of the rod 12, and a fixed backing plate 16 which secures to the enclosure channel 14 to provide for the enclosure of the rod 12 within the channel 14 and backing plate 16 assembly. Each of the above components 12, 14 and 16 may be formed in any practicable length, but are generally on the order of some two feet in length. With the standard light switch being mounted approximately four and one half feet above the floor, the lower end of the extension assembly 10 would be some two and one half feet, or 30 inches, from the floor, enabling small children and physically handicapped and wheelchair confined persons access to the lower end of the assembly to operate a switch to which the assembly is secured. Again, shorter or longer lengths of the components 12, 14, and 16 may be provided as required and/or desired.

The extension rod 12 is preferably formed of a single piece of material, and is preferably of a rectangular cross section in order to fit closely within the rectangular enclosure channel interior to preclude arcuate motion about its length. The rod 12 has a first or switch toggle contact end 18 and an opposite second or extension toggle end 20, and opposite front 22 and rear 24 sides. The rear side 24 (shown in FIG. 2B) is located facing the wall W and adjacent the backing plate 16, and includes a socket 26 therein adjacent the first end 18. This socket 26 serves to capture the toggle T of the switch S therein when the assembly is installed to the switch S and the adjacent wall W.

The front side 22 of the rod 12 includes an extension toggle 28 extending therefrom, adjacent the second end 20. This extension toggle 28 is preferably configured to have a substantially similar size and shape as the configuration of a standard, conventional light switch toggle T, in order to train small children properly and also so as not to confuse adults who are used to a conventional switch toggle T. By moving the extension toggle 28 upwardly and downwardly in the conventional manner, the switch toggle T captured within the socket 26 is actuated, with all movement being conventional. It will be noted that the present extension kit includes only a single movable component when it is installed, and that component is the extension rod 12. The other two components, the enclosure channel 14 and the backing plate 16, are fixed in place. The simplicity of the mechanical operation of the present invention results in an extremely durable and reliable device, which is quite resistant to damage from hard or continued use or inadvertent misuse from small children.

The enclosure channel 14 comprises a front face 30 having opposite first and second sides 32 (FIG. 2A) and 34 extending therefrom, and a first or switch end 36 and an opposite second or extension end 38. The first and second ends 36 and 38 are spaced apart sufficiently to contain the extension rod 12 therebetween and to allow sufficient longitudinal motion of the rod 12 as it moves to actuate a switch toggle T. The interior 40 of the enclosure channel 14 includes a plurality of guide ribs 42 therein (more clearly shown in FIG. 2A), with the guide ribs 42 having internal dimensions formed to closely fit the cross sectional dimensions of the extension rod 12, to substantially reduce or eliminate lateral play or movement of the rod 12 within the enclosure channel 14. The peripheral edges 44 and 46 respectively of the first and second sides 32 and 34 of the channel 14 also include flanges 48 on the interior edges or rims thereof, which flanges 48 serve to secure the enclosure channel 14 to the backing plate 16, as will be described further below.

In addition to the above features, the front face 30 of the enclosure channel 14 also includes a slot 50 adjacent the second end 38, providing for passage of the extension toggle 28 of the extension rod 12 therethrough. The front face 30 of the channel 14 may also include indicating means 52 (e.g., "ON" and "OFF") to either side of the slot 50, in the manner of a conventional toggle switch S, to indicate the direction of movement of the extension toggle 28 for proper operation of the switch to which the present switch extension kit assembly 10 is installed. Such indications 52 will further aid a small child in learning the conventional operation of a switch S as he or she develops.

The backing plate 16 is configured to secure to both the switch S and the wall W below the switch S to secure the assembly 10 in place, and also to secure to the enclosure channel 14. The backing plate includes a rear or wall contact surface 54 (FIG. 2C), an opposite front or enclosure channel surface 56, a first or switch contact end 58, an opposite second or extension end 60, a first peripheral edge 62, and an opposite second peripheral edge 64. The front surface 56 includes a plurality of channel flange engagement tabs 66 along the first and second peripheries 62 ad 64, extending outwardly from the front surface 56. These tabs are configured to catch the edges of the enclosure channel flanges 48 as the two components 14 and 16 are urged together, to secure the two components 14 and 16 together. The backing plate 16 may be removed from the enclosure channel 14 by prying the tabs 66 away from their engagement with the flanges 48, if disassembly is desired.

The opposite, rear surface 54 of the backing plate 16 includes a relief area 68 extending from the first end 58 for some distance along the rear surface 54. This relief area 68 provides clearance for a conventional, standard switch plate P, which typically extends outwardly from the surface of a wall W on the order of 3/16inch or so. By providing a relief area 68 in the rear surface 54 of the backing plate 16, the remaining relatively higher rear surface of the backing plate 16 will be in contact with the wall W when the backing plate 16 is installed over the protruding switch plate P. The relief area 68 also includes a passage 70 therethrough providing clearance for a switch toggle T, and holes 72 for switch plate attachment fasteners F (i. e., screws) to secure the backing plate relief area 68 to a switch plate P.

The backing plate 16 is mechanically secured to a switch plate P by means of the fasteners F, as discussed above, by removing the switch plate fasteners F from the plate P and placing the relief area 68 of the backing plate 16 over the switch plate P, and reinstalling the fasteners F through both the backing plate 16 and the switch plate P. Additional security is provided for the backing plate 16 by additional wall fastening means, such as the cooperating first and second hook and loop fastening material portions 74 and 76 (e.g., Velcro, tm) provided. The first portion 74 may be secured to the rear surface 54 of the backing plate 16, with the cooperating second portion 76 of the material secured to the wall W. Preferably, at least one set of such fasteners 74 and 76 are provided, at least at some intermediate area of the backing plate; additional securing means may be provided as desired along the length of the rear surface 54 of the backing plate 16, as shown in FIG. 2C.

Figure 2C:
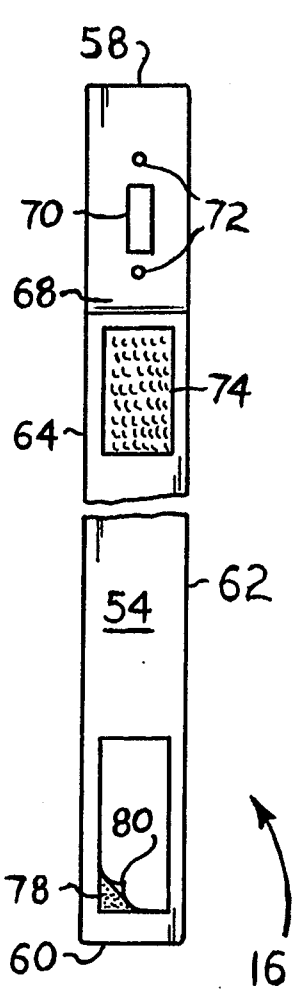
FIG. 2C is a rear view of the backing plate of the present kit, which secures to the channel to completely enclose the rod therein.
Figure 2B:
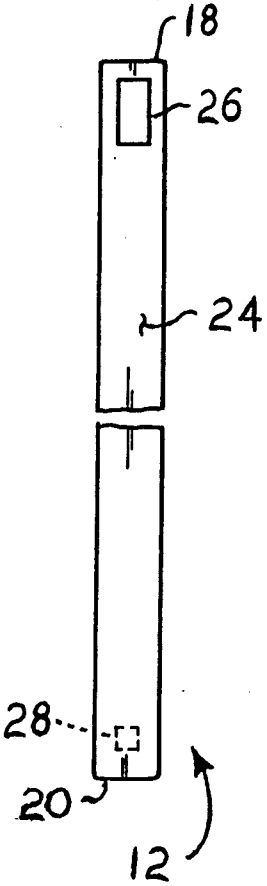
FIG. 2B is a rear view of the switch actuating rod of the present kit.
Figure 2A:
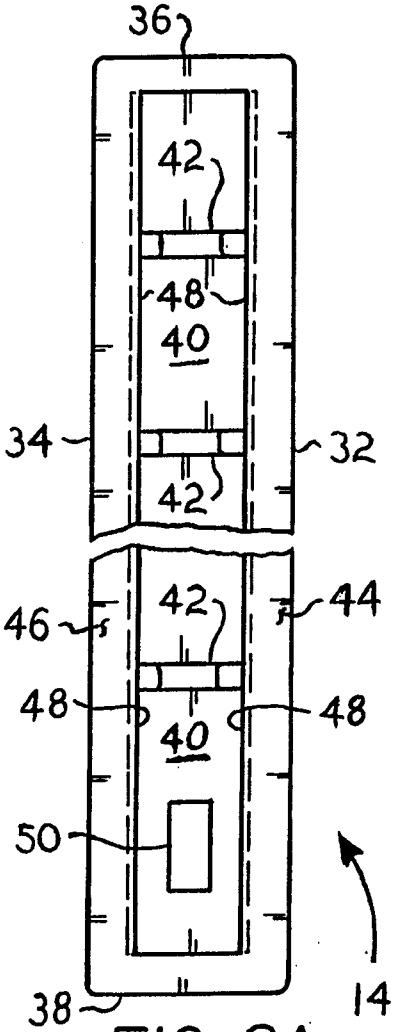
FIG. 2A is a rear view of the actuating rod channel enclosure of the present switch extension kit, showing its internal features.

Alternative means for securing the backing plate 16 to a wall W are shown in FIG. 2C, which means may be used in lieu of or in addition to the hook and loop fastening material 74 and 76 discussed above, and at intermediate or other locations along the length of the backing plate 16. In FIG. 2C, an adhesive patch 78 is provided on the rear surface 54 of the backing plate 16, near the second or extension end 60 for security thereof. The removable protective sheet 80 may be peeled from the adhesive portion 78, and the backing plate adhesively secured to the wall W. Again, such adhesive means 78 may be used instead of or in combination with other backing plate 16 securing means, and/or other (mechanical, etc.) means may be used.

The present switch extension kit 10 is assembled by placing the extension rod 12 in the enclosure channel 14, with the extension toggle 28 of the rod 12 extending through the extension toggle slot 50 in the enclosure channel 14. The enclosure channel 14 is then snapped into place on the backing plate 16, which has previously been secured to the switch plate P and wall W as discussed above, with the channel engagement tabs 66 of the backing plate 16 catching the enclosure channel flanges 48 to secure the two components 14 and 16 together. The first end 36 of the enclosure channel 14 is positioned adjacent the first end 58 of the backing plate 16 as the two components 14 and 16 are secured together, to capture and enclose the extension rod 12 therein.

The result is a switch extension which is securely mounted to both the switch plate P, using the existing mechanical means F, and is further secured to the adjacent wall W by other means discussed above. The combination of attachment means ensures that the extension will remain solidly and securely in place during use, even when misuse occurs due to operation by small children. Even though the existing switch toggle T is completely covered by the upper end 36 of the enclosure channel 14, the switch remains easy for an adult to use, as typically the extension toggle 28 is disposed only some two feet or so below the standard switch, or approximately at waist height for the typical adult. Yet, the extension toggle 28 is sufficiently close to the floor for small children old enough to be taught use of the device, to reach without undue effort. The close resemblance to a standard switch toggle T further assists those children in learning the operation of such devices.

The entire apparatus remains relatively close to the wall W, thus substantially reducing the hazard of inadvertently catching or snagging a relatively large knob, decorative protrusion, wire, etc., and damaging the device or the switch S to which it is attached. While the components 12 through 16 of the kit 10 may be formed of virtually any practicable material (e.g., metal, etc.), preferably an electrically non-conductive material (e.g., plastic) is used to provide further safety. A plastic material has the further advantage that it may be made luminescent, whereupon the luminescent property is energized by ambient sunlight during the day and/or room light when the switch S is on. When the switch S is turned off by means of the present extension and the room is darkened, the luminescence of such plastic material will enable persons to find the extension readily to operate the light(s) as needed. While it is not necessary that all of the components be formed of such luminescent plastic material, preferably at least the channel enclosure 14 is thus formed, as it is the largest exposed component of the kit 10. Alternatively, only the extension rod 12 may be so formed, to allow the extension toggle 28 to be lumnously visible in a darkened room. The enclosure of the single moving part, the extension rod 12, ensures that it will not bind against the wall W or catch on any other articles while in use. The device may be easily reproved when desired by prying the enclosure channel 14 from the tabs 66 of the backing plate 16, removing the fasteners F, and releasing the attachment means securing the remainder of the backing plate 16 to the wall W.

It is to be understood that the present invention is not limited to the sole embodiment described above, but encompasses any and all embodiments within the scope of the following claims.

I claim:

1. An extension kit providing for remote operation of a toggle switch and installable thereon, comprising:

a backing plate, an extension rod enclosure channel, and an extension rod;

said backing plate having a rear surface including wall attachment means thereon, providing for attachment of said backing plate to an adjacent wall at least one intermediate location along said backing plate;

said enclosure channel and said backing plate including means providing for mutual assembly thereof, and providing for enclosure of said extension rod therein, whereby;

said extension kit is assembled by placing said extension rod within said enclosure channel, and said backing plate and said enclosure channel are assembled together to enclose said extension rod therein, and said extension kit is installed to the toggle switch and secured to the adjacent wall by means of said wall attachment means to provide for the remote operation of the toggle switch.

2. The extension kit of claim 1 wherein:

said rear surface of said backing plate includes a relief therein, with said relief providing clearance for a switch cover plate and further providing for positioning of said rear surface of said backing plate in contact with both the switch cover plate and the adjacent wall and precluding any space between said backing plate and the switch plate and the wall.

3. The extension kit of claim 1 wherein:

said means providing for the mutual assembly of said backing plate and said enclosure channel comprises said backing plate having a front surface having a periphery with a plurality of enclosure channel flange engagement tabs extending outwardly therefrom, and said enclosure channel having an interior rim with a flange extending inwardly therefrom, with said tabs of said backing plate engaging said flange of said enclosure channel to provide for the mutual assembly thereof.

4. The extension kit of claim 1 wherein:

said extension rod includes a first end, an opposite second end, a rear side, and an opposite front side;

said rear side of said extension rod includes a socket therein adjacent said first end, with said socket adapted to capture the toggle of a switch therein;

said front side of said extension rod includes an extension toggle extending therefrom, and;

said enclosure channel includes a first end, an opposite second end, and a front face, with said front face having a slot therethrough adjacent said second end, with said slot providing for the passage therethrough of said extension toggle of said extension rod.

5. The extension kit of claim 4 wherein:

said socket of said extension rod is adapted to capture a switch toggle having a predetermined configuration, and said extension toggle of said extension rod is configured substantially similarly to said predetermined configuration of the switch toggle.

6. The extension kit of claim 4 wherein:

said front face of said enclosure channel includes indications thereon and adjacent said slot for the proper operation of said extension toggle to activate and deactivate the switch.

7. The extension kit of claim 1 wherein:

said enclosure channel includes a plurality of guide ribs therein, precluding lateral movement of said extension rod within said enclosure channel.

8. The extension kit of claim 1 wherein:

said wall attachment means of said backing plate comprises at least one first hook and loop fastener component secured to said rear surface of said backing plate, and a corresponding at least one cooperating second hook and loop fastener component secured to the wall.

9. The extension kit of claim 1 wherein:

said wall attachment means of said backing plate comprises adhesive means disposed on said rear surface of said backing plate.

10. The extension kit of claim 1 wherein:

said extension kit is formed entirely of electrically non-conductive materials.

11. The extension kit of claim 10 wherein:

said electrically non-conductive materials comprise plastic.

12. The extension kit of claim 11 wherein:

said plastic is luminescent.

13. The extension kit of claim 1 wherein:

at least said enclosure channel is formed of luminescent material.

* * * * *